US007443412B2

(12) United States Patent
Seo

(10) Patent No.: US 7,443,412 B2
(45) Date of Patent: Oct. 28, 2008

(54) EXPOSURE APPARATUS ADOPTING ORGANIC LIGHT-EMITTING DIODE ARRAY AS LIGHT SOURCE

(75) Inventor: Woon-ho Seo, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 137 days.

(21) Appl. No.: 11/485,351

(22) Filed: Jul. 13, 2006

(65) Prior Publication Data

US 2007/0040888 A1 Feb. 22, 2007

(30) Foreign Application Priority Data

Aug. 16, 2005 (KR) ..... 10-2005-0074928

(51) Int. Cl.
*B41J 2/45* (2006.01)
*B41J 15/14* (2006.01)
*B41J 27/00* (2006.01)

(52) U.S. Cl. ..... 347/238; 347/244; 347/258

(58) Field of Classification Search ..... 347/238, 347/241, 244, 258, 256; 264/40.6; 398/140
See application file for complete search history.

(56) References Cited

U.S. PATENT DOCUMENTS 5,451,997 A 9/1995 Mochizuki et al.
5,940,113 A 8/1999 Wilson
5,959,654 A * 9/1999 Yoshida ..... 347/238
6,538,682 B2 * 3/2003 Ohkubo ..... 347/241
6,650,450 B1 * 11/2003 Orino et al. ..... 398/140
2007/0096352 A1 * 5/2007 Cochran et al. ..... 264/40.6

FOREIGN PATENT DOCUMENTS

EP 1 158 334 A2 5/2001
JP 06099612 A * 4/1994
JP 2003-315712 11/2003
KR 1993-0011660 12/1993
KR 1020040093833 11/2004

* cited by examiner

*Primary Examiner*—Hai C Pham
(74) *Attorney, Agent, or Firm*—Roylance, Abrams, Berdo & Goodman, L.L.P.

(57) ABSTRACT

An exposure apparatus adopting an organic light-emitting diode (OLED) array as a light-emitting source is provided. The apparatus illuminates light beams emitted from a printing head disposed along the lengthwise direction of a photosensitive body to form an electrostatic latent image that corresponds to an image. The printing head has the OLED array in which a plurality of light-emitting sources are formed and a beam expander that focuses light beams such that exposure spots that correspond to a plurality of light beams emitted from the plurality of light-emitting sources are focused onto the photosensitive body to not overlap one another.

14 Claims, 3 Drawing Sheets

EXPOSURE APPARATUS ADOPTING ORGANIC LIGHT-EMITTING DIODE ARRAY AS LIGHT SOURCE

CROSS-REFERENCE TO RELATED PATENT APPLICATION

This application claims the benefit under 35U.S.C. § 119 (a) of Korean Patent Application No. 10-2005-0074928, filed on Aug.16, 2005, in the Korean Intellectual Property Office, the entire disclosure of which is hereby incorporated by reference.

BACKGROUND OF THE INVENTION

1. Field of the Invention

The present invention relates to an exposure apparatus. More particularly, the present invention relates to an exposure apparatus that allows light beams emitted from an organic light-emitting diode (OLED) to be focused such that images by the light beams overlap each other on the surface of a photosensitive medium.

2. Description of the Related Art

An exposure apparatus is an apparatus that scans a light beam onto a photosensitive medium to form an electrostatic latent image that corresponds to an image desired to be printed in an electrophotographic image forming apparatus.

The exposure apparatus is classified into a laser-scanning type exposure apparatus and a printer-head type exposure apparatus according to a light beam scanning type and how a light beam is scanned.

The laser-scanning type exposure apparatus is an exposure apparatus in which a light beam emitted from one light source forms an electrostatic latent image while passing along a main scanning direction of a photosensitive medium.

Alternatively, the printer-head type exposure apparatus is an apparatus in which an array of light-emitting sources (LEDs or OLEDs) is arranged in the lengthwise direction of a photosensitive medium and light beams emitted from the light-emitting sources are illuminated onto the photosensitive medium to form an electrostatic latent image.

One example of the printer-head type exposure apparatus is disclosed in U.S. Pat. No. 6,816,181 B2.

FIG. 1 is an exemplary perspective view of a printer-head type exposure apparatus of the related art. FIG. 2 is an elevational view in cross section of the exposure apparatus taken along a line A-A' illustrated in FIG. 1.

Referring to FIGS. 1 and 2, the exposure apparatus 10 includes a printer head 19, a driving device 52 applying a voltage, and a controller 50 outputting a control signal that controls the driving device 52.

The printer head 19 has an organic electroluminescence (EL) element array, a transparent substrate 12, and a convex microlens array 16.

The organic EL element array is disposed on the upper side of the transparent substrate 12 and each organic EL element is spaced with a predetermined interval in the lengthwise direction of the transparent substrate 12. The organic EL element array includes a plurality of transparent electrodes 20 (used as an anode) disposed perpendicularly with respect to the length direction of the transparent substrate 12. An organic compound layer 22 is stacked on the transparent electrodes 20 in the lengthwise direction of the transparent substrate 12. A metal electrode 24 (used as a cathode) is disposed on the organic compound layer 22. The portion 18 where the organic compound layer 22, the transparent electrode 20, and the metal electrode 24 overlap one another serves as a light-emitting source that emits light.

The transparent electrode 20 has light transmissivity of more than 50% within a wavelength region of 400-700 nm of a visual light. The organic compound layer 22 may be a light-emitting layer consisting of one layer, or may include other layers (for example, a hole injection layer, a hole transfer layer, an electron injection layer, and an electron transfer layer) besides a light-emitting layer.

The transparent substrate 12 is disposed between the organic EL element array and the convex microlens array 16 to transmit light emitted from the light-emitting source 18 through the convex microlens array 16.

The convex microlens arrays 16 are disposed on the lower side of the transparent substrate 12 along the lengthwise direction. The plurality of convex microlens arrays 16 that correspond to the plurality of light-emitting sources 18 are disposed not to overlap each other. The convex microlens array 16 focuses light so that light that has passed through the transparent substrate 12 may be focused onto the photosensitive body 14 as an exposure spot 28.

In the printer head 19, a space that has a size the same as or greater than that of the light-emitting source 18 is formed between two adjacent light-emitting sources 18 in the main-scanning direction of the printer head 19. Therefore, a space that has a size the same as or greater than that of one exposure spot 28 is formed between exposure spots formed by light emitted from the adjacent light-emitting sources and focused on the photosensitive body 14 by the convex microlens array 16.

Therefore, to fill the space between the exposure spots 28 in the main-scanning direction, the printer head 19 should move as much as the vacant space between two adjacent light-emitting sources 18 in the main-scanning direction according to the inputted image signal.

Accordingly, the function of moving the printer head 19 in the main-scanning direction to fill the vacant space between the two adjacent exposure spots 28 should be added to the controller 50 and the driving device 52 in addition to the function of turning on or off the respective light-emitting sources 18. Thus, because mechanical elements are added, a driving structure itself is complicated. Also, when a microlens has one-to-one correspondence to each light-emitting source 18, a focal length is difficult to control and the depth of focus is short, so that a control error is sensitive when an apparatus is mounted.

Accordingly, a need exists for an improved exposure apparatus in which images scanned onto a photosensitive body overlap one another.

SUMMARY OF THE INVENTION

The present invention provides an exposure apparatus in which a light-emitting source is an OLED array having a controlling beam expander, such that no vacant space is formed between exposure spots when light emitted from light-emitting sources is focused as exposure spots on a photosensitive body.

According to an aspect of the present invention, an exposure apparatus illuminates light beams emitted from a printing head disposed along a lengthwise direction of a photosensitive body onto the photosensitive body to form an electrostatic latent image that corresponds to an image. The printing head includes an OLED array having a plurality of light-emitting sources. A beam expander focuses light beams such that exposure spots that correspond to the light beams emitted from the plurality of light-emitting sources and focused on the photosensitive body overlap each other.

Other objects, advantages and salient features of the invention will become apparent from the following detailed description, which taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which exemplary embodiments of the invention are shown.

Figure 1:
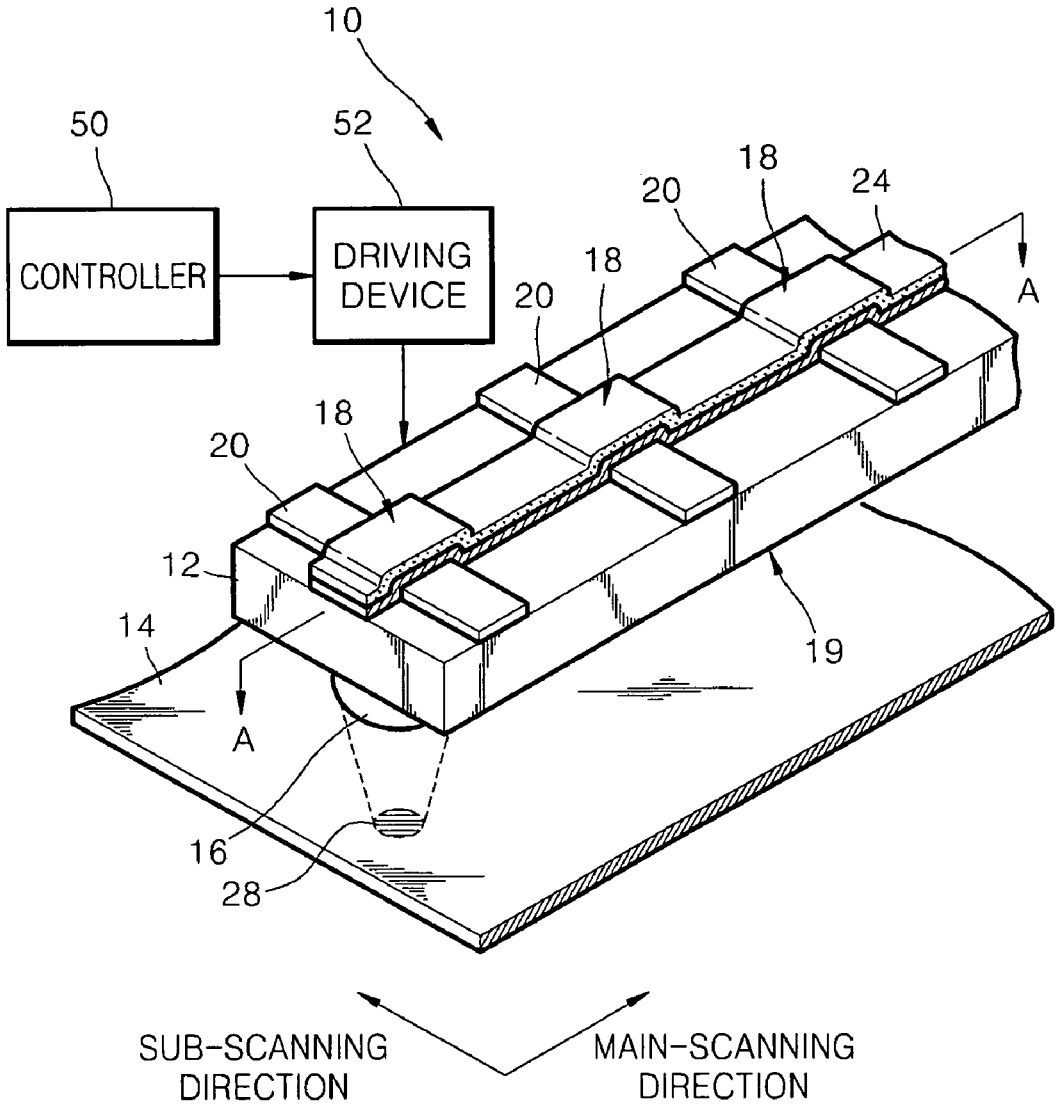
FIG. 1 (PRIOR ART)
FIG. 1 is an exemplary perspective view of a conventional printer-head type exposure apparatus.
Figure 2:
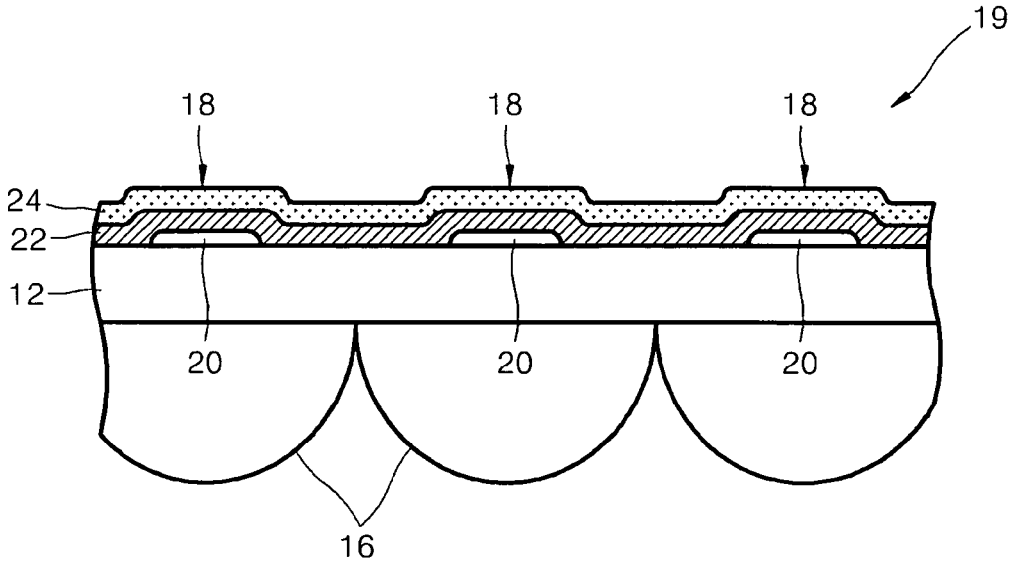
FIG. 2 (PRIOR ART)
FIG. 2 is an elevational view in cross section of the exposure apparatus taken along a line A-A' of FIG. 1.
Figure 3:
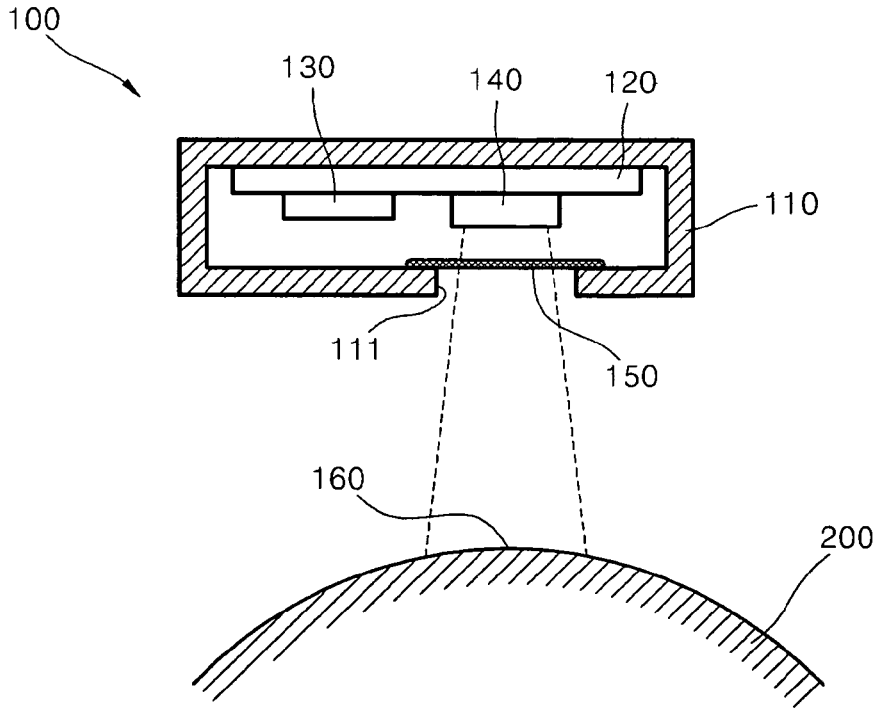
FIG. 3 is an elevational view in partial cross section of an exposure apparatus and a photosensitive body according to an exemplary embodiment of the present invention.

Referring to FIG. 3, an exposure apparatus 100 of an exemplary embodiment of the present invention is installed to be spaced a predetermined distance from a photosensitive body 200.

The exposure apparatus 100 includes a printed circuit board (PCB) 120 disposed within a housing 110 in which a passing-through part 111 is formed so that a light beam may pass therethrough. A printing head 140 is mounted on the PCB 120 to emit a light beam. A driving device 130 drives the printing head 140 to emit a light beam.

The passing-through part 111 has a window 150 protecting the printing head 140 from the outside and for transmitting a light beam therethrough.

Figure 4:
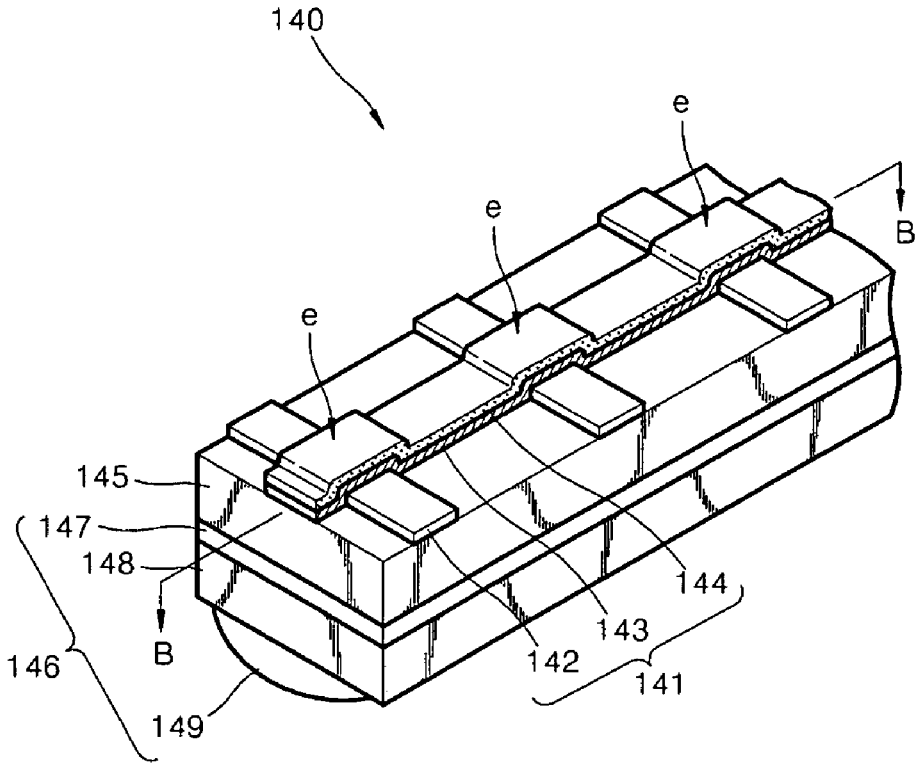
FIG. 4 is a perspective view of a printing head of FIG. 3.
Figure 5:
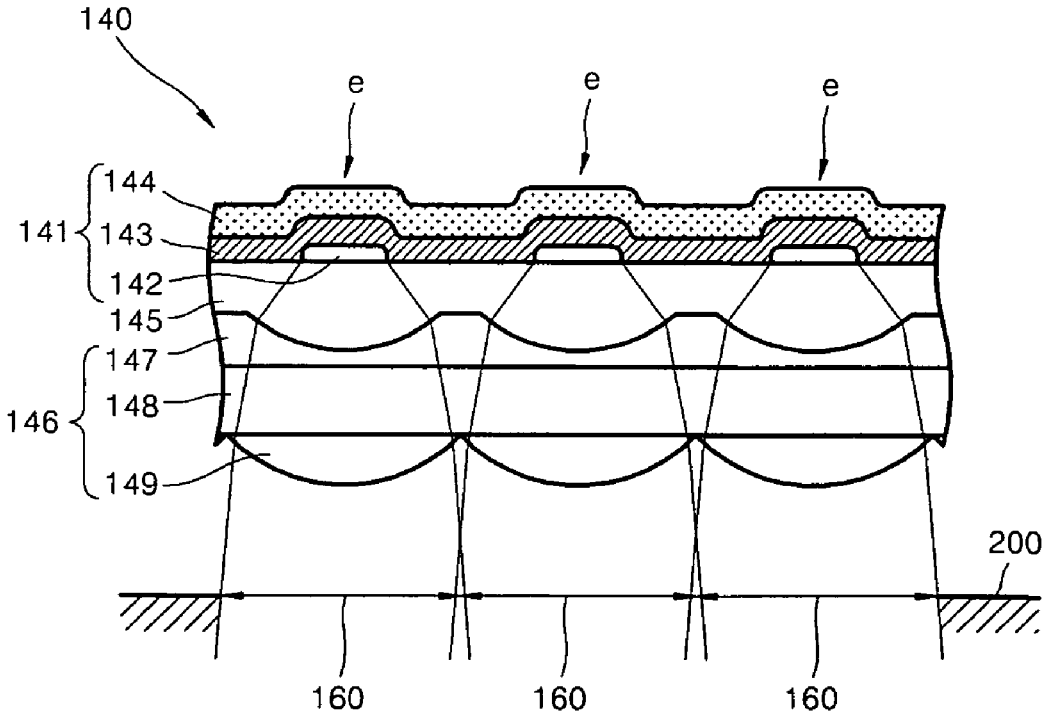
FIG. 5 is an elevational view in cross section taken along a line B-B' of FIG. 4.

Referring to FIGS. 4 and 5, the printing head 140 has an OLED array 141, a transparent substrate 145, and a beam expander 146.

The OLED array 141 includes a transparent electrode 142, an organic compound layer 143, and a metal electrode 144.

The transparent electrode 142 is used as an anode and a plurality thereof are disposed on the upper side of the transparent substrate 145 substantially perpendicular with respect to the lengthwise direction of the transparent substrate 12. The plurality of transparent electrodes 142 are spaced with a predetermined interval along the lengthwise direction of the transparent substrate 145.

The organic compound layer 143 is stacked to overlap the transparent electrode 142 along the lengthwise direction of the transparent substrate 145.

The metal electrode 144 is used as a cathode and is disposed on the organic compound layer 143.

The portion where the transparent electrode 142, the organic compound layer 143, and the metal electrode 144 overlap one another serves as a light-emitting source 'e' that emits a light beam from the organic compound layer 143. A plurality of light-emitting sources 'e' are spaced a predetermined distance from each other along the lengthwise direction of the transparent substrate 145.

The transparent electrode 142 has light transmissivity of more than 50% within a wavelength region of 400- 700nm of a visual light. The organic compound layer 143 may be a light-emitting layer consisting of one layer, or may include other layers (for example, a hole injection layer, a hole transfer layer, an electron injection layer, and an electron transfer layer) besides a light-emitting layer. The metal electrode 144 is metal having a small work function and is formed of an alkaline metal material or a compound of such metal materials as silver (Ag) or aluminum (Al).

The transparent substrate 145 is disposed on the lower side of the OLED array 141 to secure the path of a light beam emitted from the light-emitting source 'e'.

The transparent substrate 145 includes a plurality of convex shapes that correspond to the plurality of light-emitting sources 'e' and are adjacently arranged to not overlap each other. A light beam emitted from the light-emitting source 'e' progresses while diverging and is bent to a converging direction while passing through the transparent substrate 145.

According to an exemplary embodiment of the present invention, the transparent substrate 145 is formed in a plurality of convex shapes, but is not limited to this shape and may be modified into a variety of alternative shapes.

The beam expander 146 includes a negative lens array 147, a transparent spacer 148, and a positive lens array 149 that are stacked and coupled with one another.

The negative lens array 147 is disposed on the lower side of the transparent substrate 145 to correspond to the transparent substrate 145.

The transparent spacer 148 is disposed on the lower side of the negative lens array 147 to secure the path of a light beam that has passed through the negative lens array 147.

The positive lens array 149 is disposed on the lower side of the transparent spacer 148 and focuses light beams emitted from the plurality of light-emitting sources 'e' on the surface of the photosensitive body 200 such that resulting exposure spots 160 overlap each other.

The positive lens array 149 includes a plurality of convex lenses that correspond to the respective light-emitting sources 'e' and are adjacently arranged to not overlap each other.

Light beams emitted from the plurality of light-emitting sources 'e' are focused on the surface of the photosensitive body 200 such that the plurality of exposure spots 160 may overlap each other while passing through the positive lens array 149. Therefore, no vacant space is formed between the plurality of exposure spots 160.

Because the method of manufacturing the beam expander 146 by coupling the negative lens array 147, the transparent spacer 148, and the positive lens array 149 is known in the art, the description thereof is omitted.

As described above, the exposure apparatus of an exemplary embodiment of the present invention has the following effects.

First, because focusing is performed such that the exposure spots overlap each other on the photosensitive body to eliminate the vacant space between the exposure spots, the printing head does not need to move, such that control and driving thereof is simplified.

Second, because the diverging angle of a light beam emitted from the light-emitting source is reduced, the depth of focus increases and thus non-uniformity in the size of the exposure spot due to a position error of the light-emitting source with respect to the photosensitive body is substantially reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An exposure apparatus for illuminating light beams emitted from a printing head disposed along a lengthwise direction of a photosensitive body onto the photosensitive body to form an electrostatic latent image that corresponds to an image, the printing head comprising:

an organic light-emitting diode (OLED) array having a plurality of light-emitting sources;

a beam expander focusing light beams such that exposure spots corresponding to light beams emitted from the plurality of light-emitting sources are focused on the photosensitive body to overlap one another, the beam expander including a negative lens array;

a positive lens array controlling light beams emitted from the plurality of light-emitting sources to overlap one another in a predetermined size; and a transparent spacer disposed between the negative lens array and the positive lens array to secure a path of a light beam; and a transparent substrate disposed between the OLED array and the negative lens array and having a plurality of convex patterns that correspond to the plurality of light-emitting sources.

2. The apparatus of claim 1, wherein the positive lens array includes a plurality of convex lenses that correspond to the plurality of light-emitting sources.

3. The apparatus of claim 2, wherein the plurality of convex lenses are adjacently arranged to not overlap one another.

4. The apparatus of claim 1, wherein the negative lens array is coupled to correspond to the transparent substrate.

5. The apparatus of claim 1, wherein the printing head is installed within a housing in which a passing-through part for transmitting light beams therethrough is formed.

6. The apparatus of claim 5, wherein the passing-through part has a window for protecting the printing head.

7. The apparatus of claim 1, wherein the OLED array includes a transparent electrode;

an organic compound layer; and a metal electrode.

8. An image forming apparatus, comprising:

a photosensitive body;

an exposure apparatus having a printing head disposed along a lengthwise direction of a photosensitive body, the exposure apparatus illuminating light beams emitted from the printing head onto the photosensitive body to form an electrostatic latent image that corresponds to an image, the printing head comprising:

an organic light-emitting diode (OLED) array having a plurality of light-emitting sources;

a beam expander focusing light beams such that exposure spots corresponding to light beams emitted from the plurality of light-emitting sources are focused on the photosensitive body to overlap one another, the beam expander including a negative lens array;

a positive lens array controlling light beams emitted from the plurality of light-emitting sources to overlap one another in a predetermined size; and a transparent spacer disposed between the negative lens array and the positive lens array to secure a path of a light beam; and a transparent substrate disposed between the OLED array and the negative lens array and having a plurality of convex patterns that correspond to the plurality of light-emitting sources.

9. The image forming apparatus of claim 8, wherein the positive lens array includes a plurality of convex lenses that correspond to the plurality of light-emitting sources.

10. The image forming apparatus of claim 9, wherein the plurality of convex lenses are adjacently arranged to not overlap one another.

11. The image forming apparatus of claim 8, wherein the negative lens array is coupled to correspond to the transparent substrate.

12. The image forming apparatus of claim 8, wherein the printing head is installed within a housing in which a passing-through part for transmitting light beams therethrough is formed.

13. The image forming apparatus of claim 12, wherein the passing-through part has a window for protecting the printing head.

14. The image forming apparatus of claim 8, wherein the OLED array includes a transparent electrode;

an organic compound layer; and a metal electrode.

* * * * *